US005188249A

United States Patent [19]

Cargile

[11] Patent Number: 5,188,249

[45] Date of Patent: Feb. 23, 1993

[54] PLASTIC BOTTLE HAVING A LINERLESS CLOSURE WITH COLLAPSIBLE FLANGE AND METHOD

[75] Inventor: David W. Cargile, Lancaster, Pa.

[73] Assignee: Graham Packaging Corporation, York, Pa.

[21] Appl. No.: 757,711

[22] Filed: Sep. 11, 1991

[51] Int. Cl.[5] ..... B65D 1/02

[52] U.S. Cl. ..... 215/31; 215/1 C; 215/341; 215/342; 220/304; 222/109; 222/111; 222/570

[58] Field of Search ..... 215/31, 1 C, 329, 341, 215/342; 220/288, 304; 222/109, 111, 570

[56] References Cited

U.S. PATENT DOCUMENTS

| | | | |
|---|---|---|---|
| 2,889,079 | 6/1959 | Livingstone | 222/109 |
| 3,343,698 | 9/1967 | Anderson . | |
| 3,572,413 | 3/1971 | Livingston . | |
| 3,612,324 | 10/1971 | Malick . | |
| 3,784,038 | 1/1974 | Uhlig . | |
| 3,817,418 | 6/1974 | Mastrovito . | |
| 4,494,682 | 1/1985 | Beckstrom et al. | 222/570 X |
| 4,549,066 | 10/1985 | Piccioli . | |
| 4,699,285 | 10/1987 | Perne et al. | 215/252 |
| 4,771,905 | 9/1988 | Perne et al. | 215/270 |
| 4,773,560 | 9/1988 | Kitscher | 222/109 |
| 4,823,967 | 4/1989 | Thompson | 215/222 |
| 4,830,234 | 5/1989 | Odet | 222/109 X |
| 4,917,270 | 4/1990 | Simon | 222/111 |
| 4,974,749 | 12/1990 | Mon | 222/111 |

FOREIGN PATENT DOCUMENTS

| | | | |
|---|---|---|---|
| 209870 | 8/1957 | Australia . | |
| 621770 | 12/1962 | Belgium . | |
| 1218933 | 6/1966 | Fed. Rep. of Germany | 215/31 |
| 812090 | 4/1959 | United Kingdom . | |
| 1039022 | 8/1966 | United Kingdom . | |

*Primary Examiner*—Allan N. Shoap
*Assistant Examiner*—Stephen Cronin
*Attorney, Agent, or Firm*—Thomas Hooker

[57] ABSTRACT

An integral blow molded bottle having a neck, a thread surrounding the neck and a collar at the top of the neck. A circumferential flange is provided on the outside of the top of the collar and a support column is provided on the inside of the collar for limiting threading of a cap down on the neck. A circumferential groove is formed in the outside of the collar to prevent bottoming of the flange by a cap threaded onto the neck.

14 Claims, 2 Drawing Sheets

PLASTIC BOTTLE HAVING A LINERLESS CLOSURE WITH COLLAPSIBLE FLANGE AND METHOD

FIELD OF THE INVENTION

This invention relates to seals for closing one piece blow molded plastic bottles and to a method of making the bottles. The seal is formed by contact between the top of the bottle neck and a cap threaded onto the neck of the bottle.

DESCRIPTION OF THE PRIOR ART

Blow molded plastic bottles, particularly blow molded bottles with relatively large diameter necks of the type used for liquid contents, are conventionally sealed closed by threading a cap onto the neck and compressing a thin foam liner mounted on the cap against the top of the neck of the bottle. The compressed liner forms a tight liquid seal to prevent the contents of the bottle from leaking. Bottles using a foamed liner seal typically have a neck diameter of about three inches. Pour spouts are commonly fitted in the interiors of the necks to facilitate pouring of the contents from the bottles.

The foam liner adequately seals the contents of the bottle but is costly. The ability to eliminate the foam liner from the cap while retaining an effective seal would save the cost of the liner and associated assembly costs of caps which incorporate the foam liner. This cost savings could be passed on to the purchaser.

SUMMARY OF THE INVENTION

The invention relates to a linerless closure integrally formed from the top of the neck of a blow molded plastic bottle for forming a resilient seal with the cap threaded onto the neck of the bottle and to a method of making the bottle. The closure is preferably provided on blow molded bottles with approximately 3-inch diameter necks which also accommodate inserted pouring spouts. Bottles of this type are commonly used in the marketing of liquid soaps and detergents.

The closure is formed by a continuous circumferential plastic flange integrally formed in the top of the bottle neck. The outer edge and lower wall of the flange are formed during blow molding of the bottle neck. The upper wall of the flange is formed during machining of the neck at the same time the inner surface of the neck is machined for reception of the spout insert. A circumferential V-recess is located under the flange to permit resilient flexing of the flange during tightening of the cap down on the neck. The resilience of the flange assures that the flange conforms to the downwardly facing circumferential surface of the cap to provide a tight seal despite inevitable slight variations in the shape of the bottle neck and cap.

The inner end of the flange is integral with an annular stop column forming part of the neck. High torque threading of the cap onto the bottle bottoms the cap on the column while retaining resilient contact with the flange for an assured, reliable seal.

The bottle is formed by parison blow molding using mold halves having a V-shaped circumferential ridge extending around the mold halves when closed immediately above the threads on the neck. During blow molding of the parison to form the bottle, the parison is pressed against the ridge to form a circumferential V-recess extending completely around the top of the neck of the bottle above the threads of the bottle and slightly below the finished top of the neck.

After blow molding the bottle is ejected from the mold halves and plastic above the neck, including the blow dome, is removed to open the neck. The neck is then machined by extending a reamer into the interior of the neck to form an interior neck surface for reception of an optional pour spout insert and the top surfaces of the column and flange. The reaming operation completes manufacture of the bottle to provide an integral linerless closure flange having an upper machined wall and an outer edge and lower surface defined during blow molding of the bottle. The V-shaped recess below the flange formed in the bottle by the annular ridge in the mold provides space for downward flexing of the flange during tightening of the cap on the bottle. This space has sufficient axial height to prevent bottoming of the flange despite high torque tightening when the cap is first threaded onto the bottle after filling. High torque tightening bottoms the cap on the column. High torque tightening of the cap is done at about 50 to 60 foot pounds.

The consumer opens the bottle by unthreading the cap in order to pour out part of the bottle contents. The cap is then threaded back onto the bottle neck to re-engage the flange and seal the bottle closed. This low torque reclosing of the bottle need not bottom the cap on the column in order to re-engage the flange and reform a reliable seal. The resilient flange assures that the consumer, typically a housewife or homemaker, will be able to close and effectively reseal the bottle manually.

Manufacture of the bottle with the disclosed linerless closure is performed during the conventional blow molding and neck reaming operations without the necessity of additional parts or assembly operations inherent in the manufacture of the prior closure with the foam sealing ring previously used to seal closed bottles of this type. Elimination of the seal ring and of the assembly steps necessary to attach the ring to the cap considerably reduces the cost of manufacture of the bottle.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
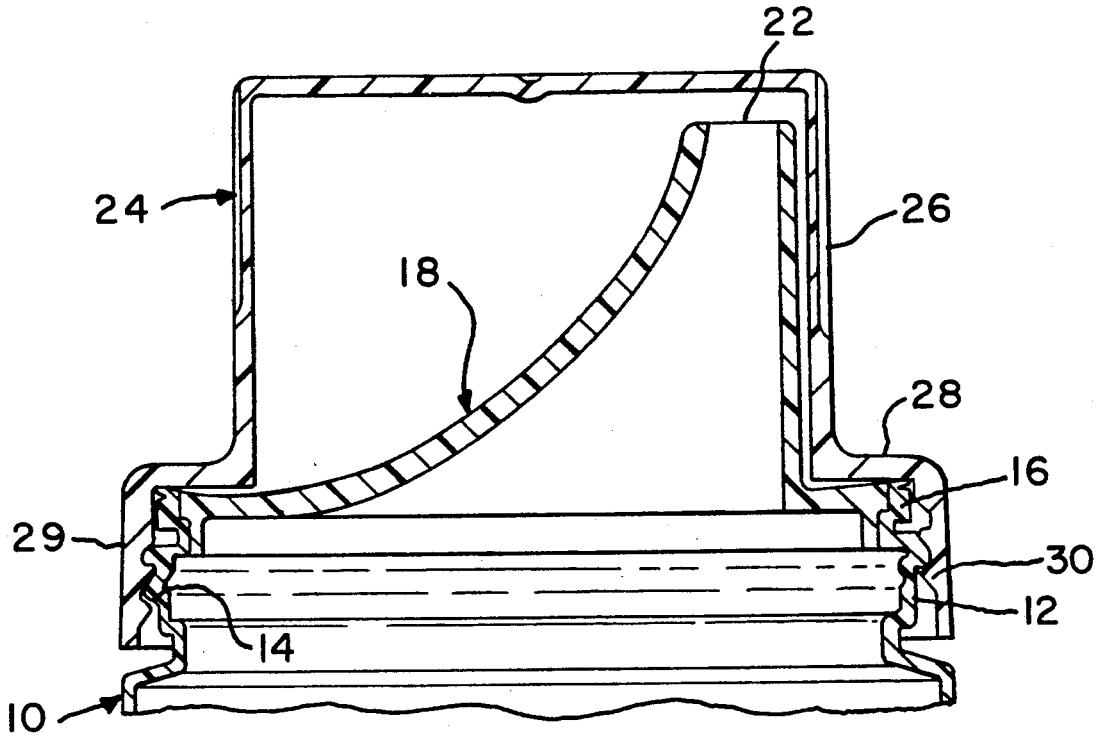
FIG. 1 is a diametrical cross section of a blow molded bottle with linerless closure, cap and pour spout insert.

A one-piece blow molded plastic bottle 10 includes a cylindrical neck 12 with a thread 14 extending around the outside of the neck. Cylindrical collar 16 forms the top of the neck 12. As illustrated in FIG. 1, the outer diameter of the collar is slightly less than the diameter of the lower portion of the neck so that thread 14 extends radially outwardly beyond the collar for engagement with the complimentary thread on the bottle cap. The neck is integrally joined to the shoulder and body of the bottle which are conventional and are not illustrated in the drawings.

A pour spout insert 18 is fitted into the interior of the neck and tightly engages machine surfaces 20 on the inside of the neck. As shown in FIG. 1, the insert includes a pour spout 22 located a distance above and adjacent one side of the neck. A drain back opening may be provided in the spout insert, if desired, in order to permit drain back of liquid into the bottle 10.

Bottle cap 24 includes an enlarged hollow cylindrical body 26 which normally, surrounds the cap insert, a radially outwardly extending lip 28 at the bottom of the cap extending outwardly the neck collar 16, and a downwardly extending annular ring 29 which is provided with an interior thread 30 complimentary with neck thread 14 to facilitate threading the cap onto the neck of the bottle.

Figure 2:
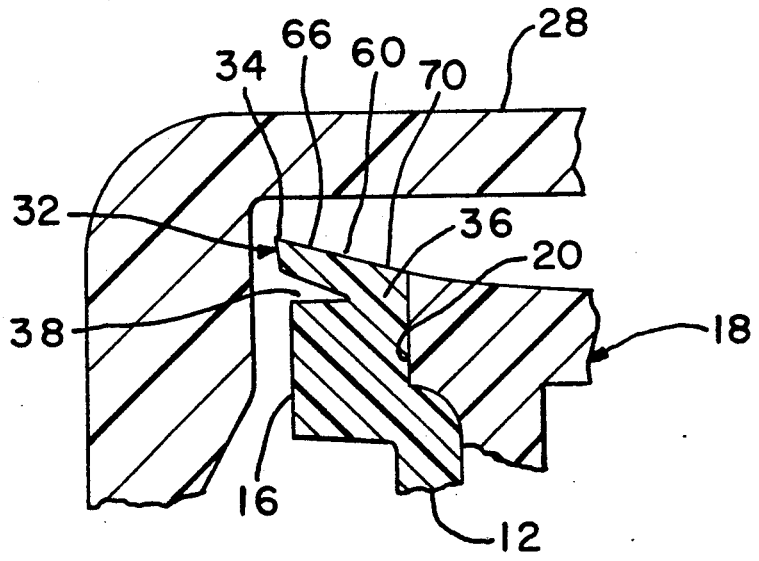
FIG. 2 is a partial diametrical cross section of the bottle neck, cap and spout prior to engagement of the cap on the neck of the bottle.

As shown in FIG. 2, the top of the annular collar 16 includes a circumferentially continuous and upwardly extending seal flange 32. The flange has a radial length approximately equal to one-half the radial thickness of the collar and extends outwardly and upwardly from the middle of the collar to a upper end 34 normally defining the top of neck 12. The inner end of the flange 32 integrally joins the upper inner half of the collar 16 which forms a stop column 36 engagable with the lower surface of ring 28 when the cap is tightly threaded onto neck 12.

An inwardly extending V-shaped circumferential groove 38 is located between flange 32 and the lower portion of collar 16 to permit resilient collapse of the flange without bottoming during tightening of the cap on the bottle neck. Groove 38 is formed during blow molding of bottle 10.

The bottle 10 is closed by placing cap 24 on neck 12 and then rotating the cap to engage threads 14 and 30 and lower the cap down on the neck to bring cap lip 28 into engagement with the sealing flange 32. The cap completely surrounds the spout insert 18 as shown in FIG. 1.

Figure 4:
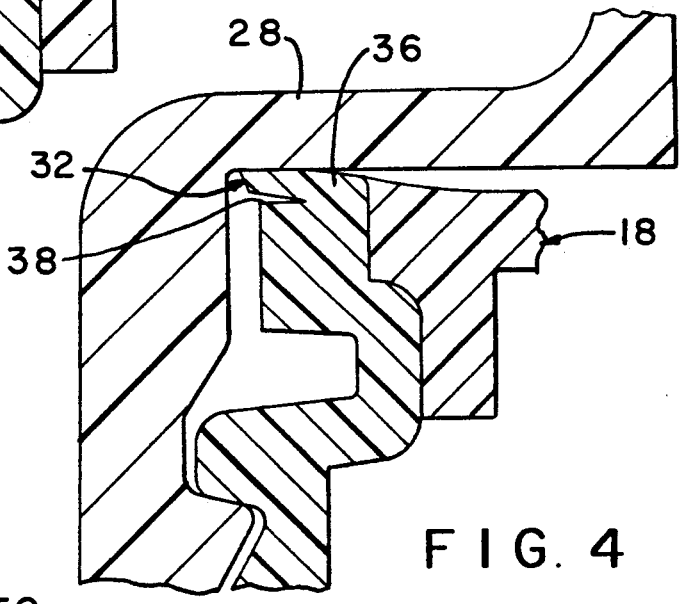

After the body of the bottle has been filled, a cap applying machine places a cap on the neck and rotates the cap down onto the flange with relatively high torque of 50 to 60 foot pounds to compress the flange down until the annular lip 28 engages stop column 36 on the inner half of the collar as shown in FIG. 4 of the drawings. Flange 32 is compressed downwardly into groove 38 to reduce the height of the groove. However, the groove has a sufficient height along the axis of the neck to prevent bottoming of the flange. In this way, the flange provides a resilient circumferential seal extending completely around the neck and completely closing the bottle when the cap is threaded onto the neck under high torque loading after filling. The high torque closing of the bottle assures that the bottle remains sealed closed for the relatively long interval between closing and initial opening by the customer.

Figure 3:
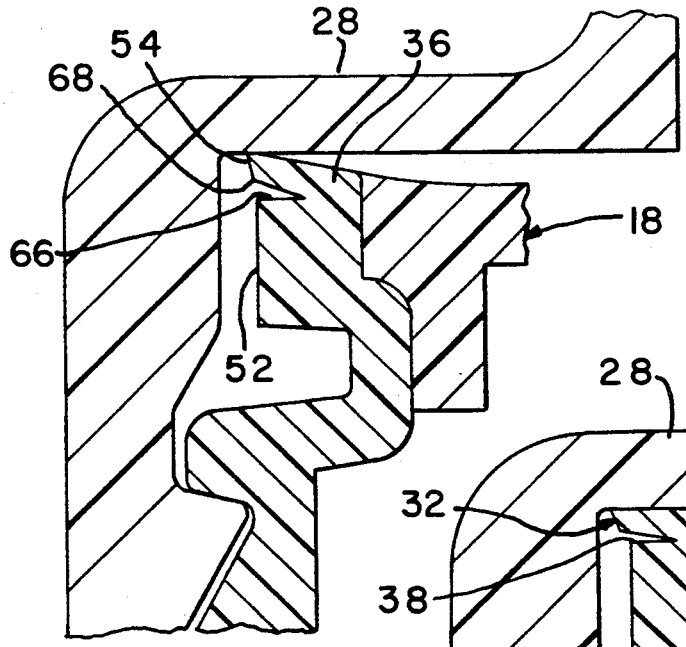
FIGS. 3 and 4 are similar to FIG. 2 and show low torque and high torque closure of the bottle, respectively.

When the customer unscrews the bottle cap from the neck the resilient flange 32 flexes up and nearly returns to its initial position of FIG. 2 and is in position to form a resilient reliable circumferential seal with the cap 24 when the customer rethreads the cap onto the neck. The torque applied during rethreading of the cap on the neck depends upon the strength of the consumer and is usually less than the high torque used to close the bottle initially. FIG. 3 illustrates the position of the cap and flange upon resealing of the bottle by the customer. Slightly greater torque applied to the cap will result in slightly greater downward deformation of the flange, depending upon the torque exerted on the cap. The resilience of the flange assures the seal continues despite production variations in the shape of the neck and cap. These variations may include variations in the geometry and locations of the threads, of the collar 16 and flange 32 and are inherent in manufacture of molded plastic products.

Bottle 10 may be manufactured using conventional parison blow molding techniques in which a molten parison of thermoplastic resin is extruded between a pair of mold halves. The mold halves close on the parison to capture the parison within a mold cavity, following which a blow needle punctures a blow dome portion of the parison located above the neck portion of the cavity and a compressed gas is flowed into the parison to inflate the parison against the walls of the cavity and form the bottle. The mold halves are cooled and quickly set the inflated parison to form a bottle having a shape defined by the shape of the mold cavity.

Figure 5:
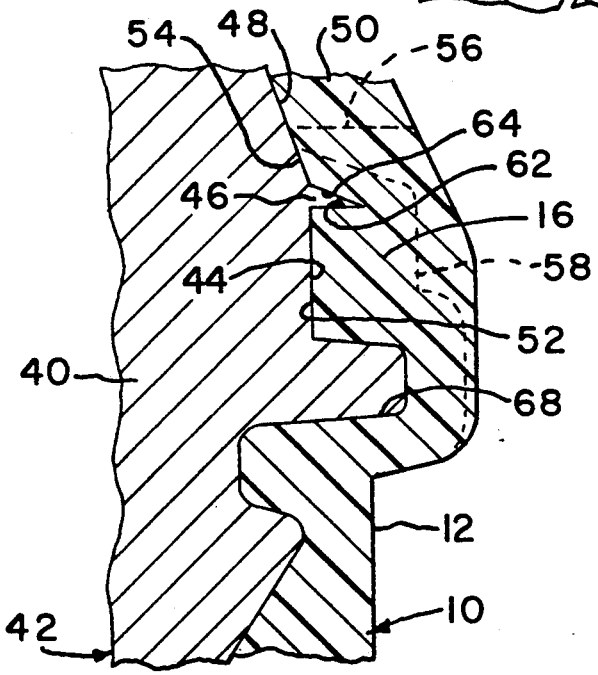
FIG. 5 is a partial sectional view taken through a blow mold used for forming a bottle with an integral linerless closure showing the upper neck portion of the mold and adjacent portion of the parison as blown against the mold.

FIG. 5 is a sectional view taken through a mold and blown parison showing a portion 40 of mold 42 which forms the top of the neck 12 of bottle 10. This portion of the mold is circular in horizontal cross section. Bottle 10 is shown expanded against portion 40.

The mold portion 40 includes a cylindrical wall 44 defining the outer surface of neck collar 16. Ridge 46 projects outwardly into the interior of the mold from the top of surface 44 and extends completely around the mold. Mold surface 48 located above ridge 46 diverges outwardly from the ridge. Ridge 46 may be an insert mounted in the mold.

Blowing and expansion of the parison forces the plastic in the parison against the walls of the mold cavity. As shown in FIG. 5, the expanded parison 50 is forced against surfaces 44 and 48 and the ridge 46 between the surfaces to form the outer wall 52 of collar 16, annular recess 38 and surface 54 located above the recess. The plastic sets in the position shown in FIG. 5, following which the mold halves are opened and the blown bottle 10 and blow dome are ejected from between the mold halves. The plastic above the neck portion of the bottle, including the blow dome, is then severed from the bottle. Severing may occur at a line 56 shown in FIG. 5.

After severing, the bottle is supported by a holder extending into recess 68 and a rotary reaming tool is extended down into the open mouth of the bottle to remove plastic from the top of the bottle. This reaming operation forms a cut upper surface 60 extending at an upward angle radially outwardly along collar 16 forming the top wall of the inner half of support column 36 and the top wall 70 of the seal flange 32. Surface 60 extends to the upper end 34 of the flange. The reaming operation also forms the surface 20 forming the inner cylindrical edge of the collar 16 and the curved lower portion of surface 20 in order to assure a tight fit with the spout insert 18 mounted in the mouth of bottle 10.

The recess 38 has a lower surface 62 lying in a plane perpendicular to the central axis of neck 12 and an upper surface 64 extending upwardly from the inner end of surface 62. Surfaces on the mold 42 define the molded surface 52 on the outside of collar 16, molded surface 62 in the collar forming the bottom of the groove, molded surface 64 on the bottle of the flange forming the top of the groove and molded surface 54 on the end of the flange. Reamed surfaces 20 and 60 form the top surface 66 of flange 32, the top surface 70 of column 36 and the surfaces on the inside of the collar assuring a fit with insert 18.

FIG. 5 illustrates blow molding the bottle using a blow dome and a blow needle to flow air into the parison during molding. Alternatively, bottle 10 may be blown by extruding a parison down and over a blow pin. The molds close on the blow pin so that air flowed through the pin inflates the parison to blow the bottle. The plastic at the blow pin forms the neck of the bottle. The mold halves used to blow the bottle using blow pin blowing include surfaces similar to surfaces 44 and 48 and ridge 46 as previously described. After ejection of the bottle from between the mold halves, a reaming operation as described is performed to form the upper surface of the flange 32 and column 36 and the interior surface of the collar for reception of spout insert 18.

The bottle 10 is formed from a suitable thermoplastic resin which, for instance, may be polyethylene. If desired, the bottle may be formed from a co-extruded parison with advantages inherent in a multi-layer construction.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A combination bottle, insert and cap for sealing the contents of the bottle comprising:

a. an integral blow molded plastic bottle having a body with a neck at the top of the body, said neck having an exterior thread, an annular collar having a smaller diameter than the said exterior thread and vertical interior and exterior walls, an annular groove mold-formed in the upper portion of the exterior wall of the annular collar between the interior and exterior walls, and a circumferential flange on the outside of the top of the collar, said flange having a formed upper surface and a lower surface opening into the mold-formed groove, both such surfaces extending inwardly and downwardly from the free end of the flange;

b. a spout insert fitted within the interior of the neck and engaging the interior wall of the collar; and c. a cap having an interior thread with which the said exterior thread of the neck threadably engages thereby permitting the cap to be held downwardly on the bottle, and a circumferential horizontal sealing surface which circumferentially engages the upper surface of the flange thereby sealing the contents of the bottle.

2. A combination as in claim 1 including a support column on the inside of the collar, a reamed surface on the top of the flange and column, the top of the column being located between the end of the flange and the recess.

3. A combination bottle and cap for sealing the contents of the bottle comprising:

a. an integral blow molded plastic bottle having a body with a neck at the top of the body, said neck having an exterior thread, an annular collar having a smaller diameter than the said exterior thread and vertical interior and exterior walls, an annular groove mold-formed in the upper portion of the exterior wall of the annular collar, a circumferential flange on the outside of the top of the collar, said flange having a reamed upper surface and a lower surface opening into the mold-formed groove, both such surfaces extending inwardly and downwardly from the free end of the flange, a reamed surface on the interior wall of the collar;

b. a cap having an interior thread with which the said exterior thread of the neck threadably engages thereby permitting the cap to be held downwardly on the bottle, and a circumferential horizontal sealing surface which circumferentially engages the upper surface of the flange thereby sealing the contents of the bottle without engaging the bottom of the said annular groove; and c. a spout insert fitted inside the neck and engaging said reamed surface on the interior wall of the collar.

4. A combination as in claim 3 wherein the groove is V-shaped with a maximum width at the exterior wall of the collar.

5. A bottle comprising a blow molded hollow plastic body and a plastic neck integral with the body at the top of the bottle, the neck including an exterior neck thread, a cylindrical collar located at the top of the neck radially inwardly of the thread, the collar having an interior wall and an exterior wall, a groove formed in the thickness of the collar between the interior wall and the exterior wall, said groove opening on the exterior wall of the collar a distance below the top of the support column and extending circumferentially around the collar, an upwardly angled circumferential seal flange on the outside of the top of the collar immediately above the groove, the end of the flange forming the top of the neck, and a circumferential cap support column on the inside of the top of the collar located a distance below the end of the flange; and a spout insert fitted within the interior of the neck and engaging the interior wall of the collar.

6. A bottle as in claim 5 wherein the vertical height of the groove is greater than the thickness of the flange to permit resilient flexing of the flange into the groove by a cap threaded onto the neck of the bottle without engaging the bottom of the groove.

7. A bottle as in claim 6 wherein the collar includes an outer cylindrical blow molded surface, the groove includes upper and lower blow molded surfaces, such upper groove surface forming the lower surface of the flange, the flange having a blow molded end surface and a reamed upper surface, the column having a reamed upper surface, the reamed surfaces being continuous and the collar including a reamed inner surface.

8. A bottle as in claim 7 wherein said groove is V-shaped in cross section and said reamed upper surfaces normally lie on the surface of a cone

9. A bottle as in claim 7 including a spout insert fitted within the interior of the neck and engaging the reamed inner surface of the collar.

10. A container including an integral blow molded plastic bottle having a body and a neck, a thread extending around the exterior of the neck, a collar at the top of the neck located radially inwardly of the thread, a circumferential groove extending into the outside of the collar below the top of the collar, a normally upwardly extending circumferential seal flange located immediately above the groove on the outside of the top of the collar, the flange having a free end defining the top of the collar, and a cap support column on the inside of the top of the collar located at a level below the free end; a spout insert fitted in the interior of the collar including a pour spout for guiding the flow of contents poured from the bottle, said spout extending above the neck of the bottle; and a cap having a cap body surrounding the spout insert, an annular lip extending outwardly from the cap body and overlying the collar, an annular ring surrounding the neck and an interior thread on the ring, said interior and exterior threads being engaged to secure the cap on the bottle and the disc against the flange, to resiliently compress the flange downwardly from the normal position and into the recess to form a seal closing the bottle.

11. A container as in claim 10 wherein said cap disc also engages the stop column and the flange in resiliently compressed into the groove without engaging the bottom of the groove.

12. A container as in claim 11 wherein the outward facing circumferential surfaces of the neck are blow mold-formed, such surfaces including the outer surface of the collar, the surfaces of the groove and the outer surface of the flange, and the upwardly facing surfaces of the collar and an adjacent inwardly facing surface of the collar are reamed, the spout insert engaging such inwardly facing surface.

13. A bottle comprising a blow molded hollow plastic body and a plastic neck integral with the body at the top of the bottle, the neck including an exterior neck thread, a cylindrical collar located at the top of the neck radically inwardly of the thread, a groove formed in the thickness of the collar a distance below the top of the neck and extending circumferentially around the exterior of the collar, an upwardly angled circumferentially around the exterior of the collar, an upwardly angled circumferential seal flange on the outside of the top of the collar immediately above the groove, the end of the flange forming the top of the neck, and a spout insert fitted within the interior of the neck and engaging the inner surface of the collar.

14. A bottle as in claim 13 including a circumferential cap support column on the inside of the top of the collar located a distance below the end of the flange.

* * * * *

UNITED STATES PATENT AND TRADEMARK OFFICE

CERTIFICATE OF CORRECTION

PATENT NO. : 5,188,249

DATED : February 23, 1993

INVENTOR(S) : David W. Cargile

It is certified that error appears in the above-indentified patent and that said Letters Patent is hereby corrected as shown below:

On the title page, Item [54]:

Change the title to read: "Plastic Bottle Having a Linerless Closure with Collapsible Flange".

Claim 11, column 7, line 18, change "in" to --is--.

Claim 13, column 8, lines 13 and 14, delete "an upwardly angled circumferentially around the exterior of the collar,".

Signed and Sealed this

Twenty-eighth Day of December, 1993

*Attest:*

Bruce Lehman

BRUCE LEHMAN

*Attesting Officer*

*Commissioner of Patents and Trademarks*